United States Patent [19]

Yang

[11] Patent Number: 4,637,673

[45] Date of Patent: Jan. 20, 1987

[54] EASILY DISASSEMBLABLE SEPARATE CEILING FAN SWITCH BOX STRUCTURE AND AN ELECTRICAL CONNECTOR THEREFOR

[76] Inventor: Tai-Her Yang, 5-1 Taipin St., Si-Hu Town, Dzan-Hwa, Taiwan

[21] Appl. No.: 765,120

[22] Filed: Aug. 13, 1985

[51] Int. Cl.[4] ..... H01R 13/623

[52] U.S. Cl. ..... 339/89 M; 339/135

[58] Field of Search ..... 339/17 C, 89 R, 89 M, 339/135, 197 R, 197 B; 200/298, 299, 303

[56] References Cited

U.S. PATENT DOCUMENTS

| | | | |
|---|---|---|---|
| 447,832 | 3/1891 | Kintz | 339/89 R |
| 1,319,642 | 10/1919 | Buchsbaum | 200/298 |
| 1,650,549 | 11/1927 | Thomas | 200/298 |
| 1,883,621 | 10/1932 | D'Olier, Jr. | 339/135 |
| 2,567,961 | 9/1951 | O'Brien et al. | 200/299 |
| 2,700,140 | 1/1955 | Phillips | 339/89 M |
| 2,716,740 | 8/1955 | Parish | 339/89 R |
| 2,740,098 | 3/1956 | Phillips | 339/89 R |
| 2,766,434 | 10/1956 | Gear | 339/197 B |
| 3,233,202 | 2/1966 | Kyle | 339/89 R |

*Primary Examiner*—John McQuade

*Attorney, Agent, or Firm*—Leonard Bloom

[57] ABSTRACT

An easily disassemblable separate ceiling fan switch box structure which makes the upper cover and the lower housing body of the switch box locked and joined. Its upper cover can join to a wire distribution receptacle which connects to the wires of the elements of the switch device. The said wire distribution receptacle can couple with the wire distribution receptacle connected to the wires of the ceiling fan motor and then a fixing sleeve ring fixes and joins them. Further an annular or frame-shaped PC board can also be installed in the inner part of the lower housing body to allow the said elements and their wire distribution receptacle to be directly installed thereon, hereby making the ceiling fan switch box structure simplified and compact for convenient disassembly or assembly.

1 Claim, 5 Drawing Figures

EASILY DISASSEMBLABLE SEPARATE CEILING FAN SWITCH BOX STRUCTURE AND AN ELECTRICAL CONNECTOR THEREFOR

FIELD OF THE INVENTION

An easily disassemblable separate ceiling fan switch box structure comprised of an upper cover and a lower housing body. The upper cover of the switch box can be movably joined to a wire distribution receptacle. A wire distribution receptacle is also provided in the lower housing body. These two wire distribution receptacles can join together as a single identity. Further features lie in that an annular or frame-type printed circuit (PC) board may be provided in the lower housing body of the ceiling fan switch box and is equipped with a wire distribution receptacle to directly couple with the other wire distribution receptacle.

BACKGROUND OF THE INVENTION

Conventional ceiling fan switch boxes use the integral sealed fixed design. The elements such as switch device, capacitor and its wires are disposed in the box content. This often makes the circuits in its inner part crowded in a disordered manner, and also often cause troubles, whenever it is necessary to disassemble, maintain and repair contents in the box. Further, due to the crowded state of the elements and circuits in the box, during manufacturing, the production line operations make the operations of connecting various elements difficult, especially where contact points of the circuits are numerous, thereby causing a great disadvantageous impact on the production efficiency.

SUMMARY OF THE INVENTION

The present invention relates to a structural design of the easily disassemblable separate ceiling fan switch box, the main feature of which lies in that a wire distribution receptacle to be connected to the wire of the ceiling fan motor is equipped under the motor of the ceiling fan and that a disassemblable wire distribution receptacle is installed on the upper cover of the ceiling fan switch box to make these two wire distribution receptacles directly coupled together. A fixing sleeve ring is used to fix and join the said two receptacles, thus forming an easily disassemblable switch joint. In another embodiment a printed circuit board is installed in the lower housing body in the ceiling fan switch box to make various elements directly couple with the PC board. A wire distribution receptacle is installed on the PC to make another wire distribution receptacle directly coupled so as to solve the defects of the above-said conventional structures.

DETAILED DESCRIPTION OF PREFERRED EMBODIMENT

Figure 1:
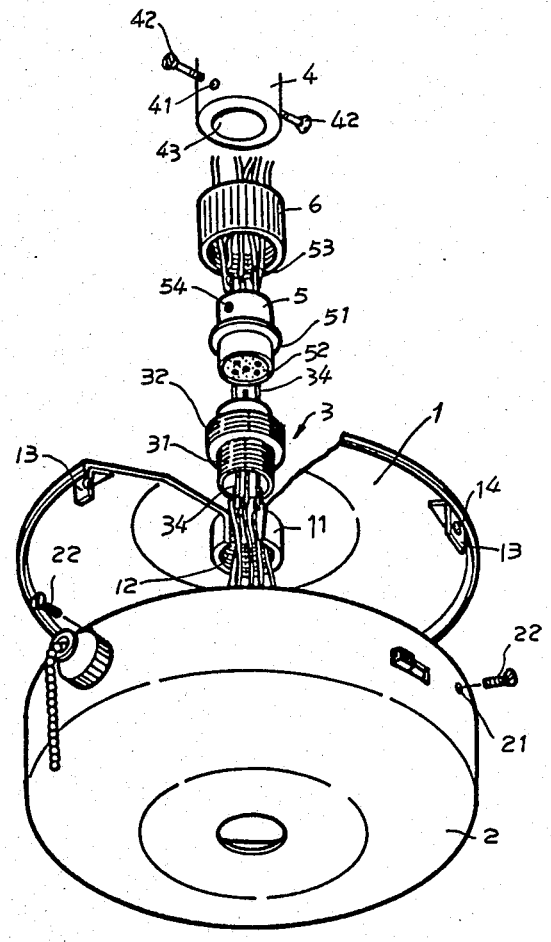
FIG. 1 is the tri-dimensional exploded view of the structure according to the present invention.

As shown in FIG. 1, the ceiling fan switch box of the invention is mainly composed of an upper cover (1) and a lower housing body (2). An inwardly facing flange (11) is provided in the central part of said upper cover (1). A through screw hole (12) is provided in the center of said flange (11). Two or more positioning plates (13) are provided on the inner circumference of said upper cover (1). A threaded hole (14) is provided on each of said positioning plates (13).

The above-said lower housing body (2) accommodates such elements as the conventional switch device, capacitor, etc. The wires of various elements are connected to a wire distribution receptacle (3). Two or more through holes (21) corresponding to the respective positioning plates (13) are on the said upper cover (1) are provided on the circumference of the lower housing body (2) to receive the screw (22) therethrough for locking or releasing the assembly of the joint between the upper cover (1) and the lower cover (2).

The said wire distribution receptacle (3) is in a cylindrical design. Threads are provided on the circumferences of the small bore (31) under it and the large diameter (32) in the middle section. Said small diameter (31) and the screw holes (12) in the central flange (11) of the upper cover (1) are mutually joined and positioned by the screw. The center of the wire distribution receptacle (3) is in a hollow form with an insulator (33) provided on its top and several conductors (34) dispersely installed thereon. Various said conductors (34) are welded to the wires of the said element according to the respectively set corresponding relationship between and among the elements.

In this invention, a wire distribution receptacle (5) is provided under the axle center (4). A flange (51) is provided on the middle section about the circumference of the said wire receptacle (5). The center of said flange (51) is also in a hollow design. Similarly an insulator (52) is provided in the end of said central hole. Several conductors (53) are welded and fixed to the wires of the ceiling fan and motor according to the set corresponding relationship between them. A screw hole (54) is provided in the circumference on the top of the wire distribution receptacle (5) and corresponds to the screw hole (41) provided in the axle center (4) of the ceiling fan motor to receive the screw (42) therethrough and to be locked therebetween.

Figure 2:
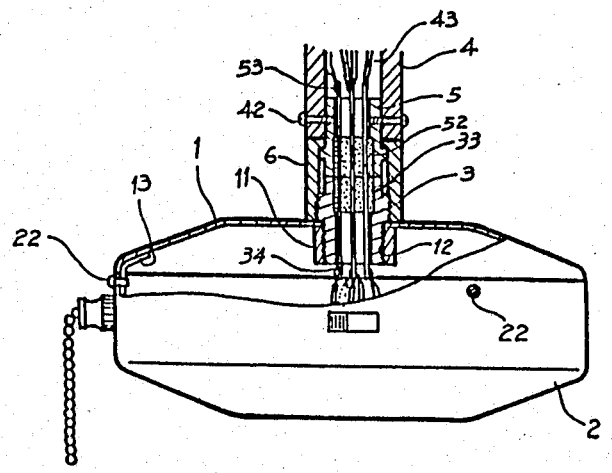
FIG. 2 is the cross sectional view of the assembly of the structure according to the present invention.

FIG. 2 is the view of the assembled state of this device, after the said wire distribution receptacle (3) and the upper cover (1) are mutually joined together. Another wire distribution receptacle (5) can directly couple with the receptacle (3) according to the corresponding relative positions. A fixing sleeve ring (6) is used for fixing and joining these parts. The inner diameter of said fixing sleeve ring (6) is provided with threads which mutually couple with those on the external surface of the large diameter (32) in the middle section of the wire distribution receptacle (3). Ring (6) is of a diameter to just mutually catch and stop the flange (51) provided on the middle section of the circumference of another wire distribution receptacle (5) to form a stable joint relationship. During assembly, the wire distribution receptacle (5) makes its upper end extend out of the fixing sleeve ring (6) so as to be inserted into the central hole (43) in the motor axle center (4). Located thusly, it is locked and positioned thereon by a screw (42), thereby completing the assembly work of the overall structure.

The features of such a ceiling fan switch box structure lies in that the disassembly work can be made on upper cover (1) and lower housing body (2) conveniently by loosening the said screw (22); and that by loosening the said screw (42), the entire switch box can be disassembled and dismounted therefrom for maintenance and repair.

Figure 3:
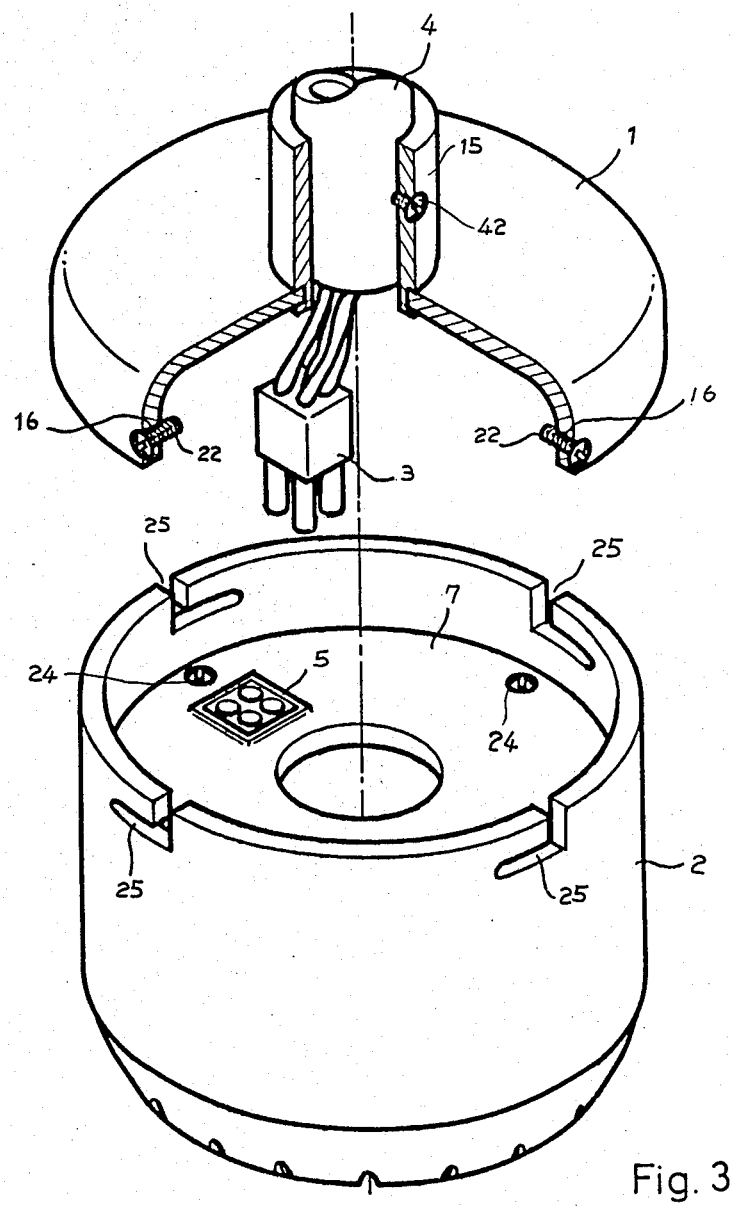
FIG. 3 is the tri-dimensional exploded view of the structure of another embodiment according to the present invention.
Figure 4:
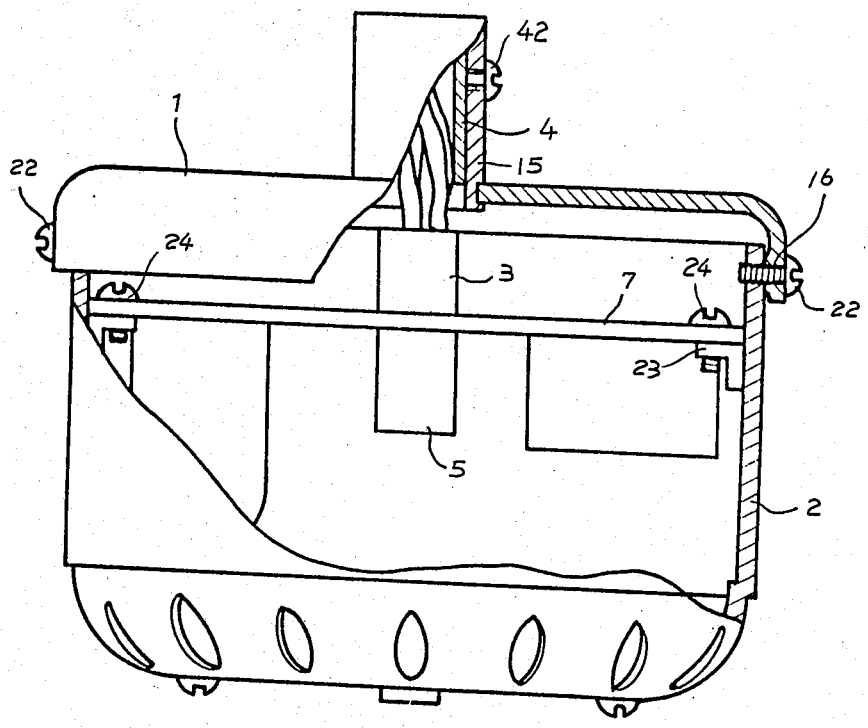
FIG. 4 is the tri-dimensional view of the embodiment shown in FIG. 3 according to the present invention.

Shown in FIGS. 3 and 4 are views of another embodiment of the invention, wherein several positioning plates (23) are provided on the inner circumference of the lower housing body (2). A screw (24) locks an annular PC board (7), on which predesigned circuit conducting connection circuits are provided, to directly connect the related elements such as switch device, capacitor etc. Further the said wire distribution receptacle (5) is also directly coupled on board (7) thereby forming an integral arrangement. Further, a wire distribution receptacle (3) is provided in the inner part of the upper cover (1). During assembly said wire distribution receptacle (3) can directly and mutually couple with the wire distribution receptacle (5) provided on the PC board (7) according to the set relationship thereby forming a complete control circuit (as shown in FIG. 4).

Figure 5:
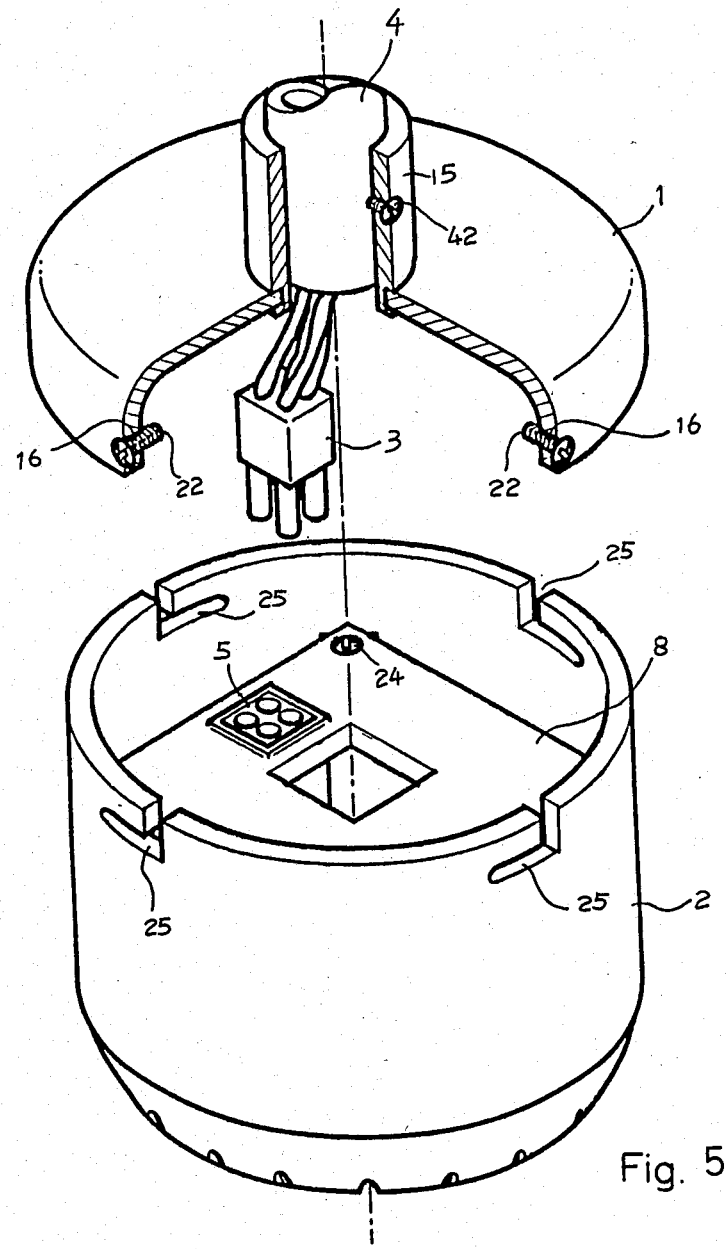
FIG. 5 is the tri-dimensional view of another embodiment shown in FIG. 3 according to the present invention.

In FIG. 5 is another embodiment of this structure wherein a frame-type PC board is locked in the same manner as said above in the inner part of the lower housing body (2). The action of said frame-type PC board (8) is identical to that of the above-said annular PC board (7).

In this embodiment the upper cover (1) directly uses the flange (15) on its top end face to couple with the axle center (4) of the ceiling fan motor. A screw (42) locks and positions them thereon. The joining device between the upper cover (1) and the lower housing body (2) employs the rotatable rabbeting way (actually, a bayonet slot). Two or more screw holes (16) are provided in the circumference of the upper cover (1), and a screw (22) is screwed into each of the said screw holes respectively. Further two or more "L"-shaped positioning slots (25), corresponding to the screws provided on the upper cover (1), are provided in the circumference of the lower housing body (2). The said "L"-shaped positioning slots (25) mutually couple with the screws (22) and are turned to an angle to slide the screw (22) into the "L"-shaped positioning slot (25) which is then locked by tightening the screw (22) therein, thereby completing the locking and joining job for the upper cover (1) and the lower housing body (2).

The feature of this embodiment lies in that various circuit components can directly be manufactured with the PC boards (7), (8) in an integral identity which is then installed in the inner part of the lower housing body. This can simplify the assembly work in the production lines and avoid too many contact points, the mutual entanglement of the wires of various elements and the overcrowded state of the wires in the inner part of the lower housing body (2), thereby maximizing the production efficiency. Besides, just like the above-said device, this embodiment also has the same easy and convenient disassembly and dismounting feature.

I claim:

1. A disassemblable ceiling fan switch box structure of the type for housing therein electrical components of a ceiling fan having electrical wires, in combination, comprising:

an upper cover, the center of which has an inwardly extending flange, and further having a through screw hole formed in the center of said flange;

two or more positioning plates positioned on the inner circumference of said upper cover, each of said positioning plates having a screw hole formed therein;

a lower housing body for receiving therein the electrical components and the electrical wires thereof, said lower housing body having two or more positioning holes formed therein corresponding to the positioning plates;

a first hollow distribution receptacle being substantially cylindrical in shape, having a middle section of enlarged diameter and defining therebelow a lower section of reduced diameter, said middle section and said lower section being threaded on the outer surface thereof;

insulation disposed in said first receptacle;

a second hollow distribution receptacle being substantially cylindrical in shape, and having a middle section of enlarged diameter, said second receptacle having a screw hole formed therein;

insulation disposed in said second receptacle;

a hollow fixing sleeve ring being substantially cylindrical in shape, said sleeve ring being threaded on the inner surface thereof and having an upper end of reduced internal diameter;

said second receptacle being received in the fixing sleeve ring, whereby the middle section of the second receptacle abuts the upper end of the fixing sleeve ring;

said first receptacle being received in the fixing sleeve ring, whereby the middle section of the first receptacle threadily engages the interior of the fixing sleeve ring;

said first receptacle being received in and threadily engaging the screw hole of the upper cover;

whereby the wires of the electrical components are disposed within the screw hole, first receptacle, and second receptacle respectively.

* * * * *